US006036271A

United States Patent [19]

Wilkinson et al.

[11] Patent Number: 6,036,271

[45] Date of Patent: Mar. 14, 2000

[54] SELF-ADJUSTING PRESSURE RELIEF SEATING SYSTEM AND METHODOLOGY

[75] Inventors: John W. Wilkinson, Bennington, Vt.; Richard W. Raburn, Simpsonville, S.C.

[73] Assignee: Span-America Medical Systems, Inc., Greenville, S.C.

[21] Appl. No.: 08/557,307

[22] Filed: Nov. 14, 1995

Related U.S. Application Data

[63] Continuation-in-part of application No. 08/253,982, Jun. 3, 1994, Pat. No. 5,652,985.

[51] Int. Cl.[7] ..... A47C 7/02

[52] U.S. Cl. ..... 297/452.41; 297/452.55; 297/219.1; 297/284.3; 297/DIG. 4; 5/654

[58] Field of Search ..... 297/DIG. 3, DIG. 1, 297/452.55, 452.41, 284.3, 284.6, DIG. 4, 219.1, 228.13, 284.1, 284.9; 5/654, 655.3, 709, 710

[56] References Cited

U.S. PATENT DOCUMENTS

| | | | |
|---|---|---|---|
| 3,533,113 | 10/1970 | Stamberger | 297/452.41 X |
| 3,611,455 | 10/1971 | Gottfried | 5/709 X |
| 3,644,950 | 2/1972 | Lindsay, Jr. | 5/710 X |
| 4,212,496 | 7/1980 | Kirkham, Jr. . | |
| 4,629,246 | 12/1986 | Fulton | 297/DIG. 4 X |
| 5,082,326 | 1/1992 | Sekido et al. | 297/DIG. 3 X |
| 5,142,717 | 9/1992 | Everard et al. . | |
| 5,433,506 | 7/1995 | Jensen | 297/452.41 X |
| 5,558,398 | 9/1996 | Santos | 297/DIG. 3 X |

*Primary Examiner*—Milton Nelson, Jr.
*Attorney, Agent, or Firm*—Dority & Manning, PA

[57] ABSTRACT

A seating system is designed for self-adjusting pressure relief for use with wheelchairs and other generally confined seating arrangements. One or more support chambers filled with resilient foam and a fluid such as air are arranged on an upper support surface. A self-adjusting reservoir is provided and arranged in fluid communication with the chamber. A constant force spring cooperates with a pivoting plate arrangement and acts on the reservoir so as to balance fluid pressure between the reservoir and the support chamber with a patient received thereon. In some embodiments, three fluid/resilient foam chambers may be provided for independent operation with three respective adjustable reservoirs. In other embodiments, fluid filled chambers may be operatively associated with respective reservoirs and pivoting actuation plates specially adapted to fit below a wheelchair seat without interfering with the wheelchair support structure, or specially adapted to be carried in a pack on the wheelchair seat back. Present arrangements may be modified for use with other seating conditions, such as geriatric chairs and seats for vehicles of all types.

42 Claims, 11 Drawing Sheets

SELF-ADJUSTING PRESSURE RELIEF SEATING SYSTEM AND METHODOLOGY

This application is a continuation-in-part application of U.S. Ser. No. 08/253,982, filed Jun. 3, 1994, now U.S. Pat. No. 5,652,985, priority on which is claimed pursuant to 35 U.S.C. §120. All disclosure, drawings, and complete contents of such '982 application are fully incorporated herein by reference.

BACKGROUND OF THE INVENTION

This invention generally relates to the field of pressure relief and more particularly to self-adjusting pressure relief seating systems and to corresponding methodologies.

Particularly in the field of healthcare, there has been a long felt and profound need to provide pressure relief for immobile or otherwise confined patients. For a tremendous variety of reasons, many patients must withstand long periods of bed rest or other forms of confinement, such as use of a wheelchair or other accommodating but restrictive support arrangement. In those instances, there is a tremendous risk that exposures to excess pressures, or longer term exposures to relatively lower pressure levels, can result in painful and even dangerous sores and other conditions.

Literally an entire segment of the healthcare industry is directed to the study and treatment of various tissue traumas, such as decubitus ulcers. Tissue damage can be monitored and rated, with progressively higher ratings warranting more involved treatment approaches. Consequently, the healthcare industry perceives and evaluates treatment options on the basis of their ability to address conditions at such different stages or ratings.

Some patient conditions to be addressed are not initially caused by excess pressure damage. For example, burn patients often have critical and even life threatening tissue care needs, but which did not originate from an excess pressure condition. Again, the initial condition of the patient is also ratable, which tends to dictate the measure of response.

Still further patients or others may have special needs. For example, injured patients, such as hip fractures or the like, may require special support care during a recovery period. Still other patients may have more long term specialized needs, such as amputees, who may have pressure sensitive areas and pressure points not accounted for by a support arrangement designed for a patient having weight dispersed over all limbs.

Literally scores of products, based on various technologies, have sought to address the constantly ongoing problem referenced above. As addressing the higher rated problems is, in general, technically more difficult, the costs of available treatments tend to rise in proportion with the rating magnitude of the problem.

Generally speaking, while cost containment has always been of concern in the healthcare industry, it has recently become a much more significant issue. As a net result of various forces acting with a goal of reducing costs, it is possible that the treatment needs (whether preventative or curative) of specific patients may run the risk of being inappropriately or even inadequately addressed.

Over time, as in any sort of industry, efforts have been made to simultaneously improve both quality (in the sense of product performance) and price. Typically, it can be difficult to simultaneously achieve both such goals, especially whenever product performance improvement comes at the expense of more entailed and sophisticated technologies. In addition, it is frequently the case that achieving top performance (i.e., optimized pressure relief or dispersion) is highly challenging, regardless of the available technology, at any cost. One contributing factor is the tremendous variation in patient needs which must be potentially met by a particular product (i.e., support system or methodology).

Typically, various support systems have made use of resilient support bodies, such as strips or blocks of foam, or some other support bladder containing a specific fluid. Mattress technologies, in general, have often made use of other resilient support media, such as springs, slats, or various support fillers, such as ticking. Different gases, often such as air, or various liquids have been used, including relatively viscous liquids, such as gels. In some instances, combinations of the above various technologies have been used.

As an effort to provide various cost effective designs applicable in different circumstances, there has generally been a progression in the sophistication of various products. For example, a repeating pattern such as convolutions may be readily formed in a resilient foam product for providing a resilient mattress supplement. See, for example, U.S. Pat. No. 4,686,725 entitled "Mattress Cushion with Securement Feature." While various repeating surface patterns are readily produced, more complicated repeating surface patterns have been provided in efforts to improve product performance over convoluted pads. See, for example, U.S. Pat. No. 4,901,387 entitled "Mattress Overlay with Individual Foam Springs."

One aspect of support systems, especially concerning those for use with recumbent patients, is that they are faced with distinctly different loading requirements along the longitudinal axis thereof. In other words, certain body areas of a patient will be heavier than others, thereby generally requiring greater support in such longitudinal areas if pressure relief is to be optimized.

As a result, various support pads have sought to provide sectionalized support. One such resilient foam pad making use of a uniform patterned surface, though with differential resilient support responsive to different loads, is U.S. Pat. No. 5,007,124 entitled "Support Pad with Uniform Patterned Surface."

As foam surface patterns become more sophisticated, there is a corresponding increase in the difficulty of producing such articles. One example of a three section foam mattress is U.S. Design Pat. No. 336,400, entitled "Foam Mattress Pad." Another example of a still more complicated foam mattress surface, typically requiring a computer controlled cutting machine for production, is U.S. Pat. No. 4,862,538, entitled "Multi-Section Mattress Overlay for Systemized Pressure Dispersion."

Still further examples of various resilient foam support pads and the like, and certain aspects of manufacture thereof, are shown by U.S. Pat. No. 4,603,445; U.S. Pat. No. 4,700,447; U.S. Design Pat. No. D307,688; U.S. Design Pat. No. D307,689; U.S. Design Pat. No. D307,690; U.S. Pat. No. 5,025,519; U.S. Design Pat. No. D322,907; and U.S. Pat. No. 5,252,278. Generally speaking, as support surface designs become more entailed, they become more difficult and more expensive to produce. At the same time, regardless of the manufacturing cost, they provide a generally static or preset response to loading changes, i.e., changes in the weight of the patient being supported in a specific region of the pad. Such variations may occur due to the variations among patients, or simply to the movement of an individual patient.

Other technologies involving fluid filled support bladders of various sorts may be incorporated into different types of systems regarded as either static or dynamic. Typically, what is meant by a static system is that the fluid level within a particular support chamber is sealed or otherwise relatively unchanged (or constantly replenished against losses). The pressure dispersion offered with such a system is thus, in at least one sense, analogous to the preestablished response expected with fixed resilient foam systems. However, it will be apparent to those of ordinary skill in the art that a fluid filled chamber approach, even in a static condition, would provide hydraulic fluid flow performance not found in a resilient foam system. Of course, the net pressure relief performance of any system or methodology encompasses various factors.

One example of a pressure relief support system utilizing fluid filled chambers is shown by U.S. Pat. No. 5,070,560, entitled "Pressure Relief Support System for a Mattress." In such patent, sealed longitudinal air cylinders are provided in the shape of a mattress, otherwise having various transverse slats and/or foam strips or members. Such a support system offers air dispersion pressure treatment in a static design which avoids the relative extremely high cost and other negative factors often associated with active air bed systems.

Highest rated pressure relief support systems typically involve beds having a plurality of fluid filled chambers, the internal pressures of which are maintained at a constant pressure by a relatively higher technology dynamic system approach. Specifically, each fluid filled support element may be associated with its own control valve, alternately permitting ingress and egress of fluid. Various pressure sensitive detection devices typically may be utilized in a feedback control system for determining that an excess pressure condition (or a subpressure condition) exists. Thereafter, the control technology is operative for bleeding off excess pressure by selected valving operation (such as dumping excess fluid into a reservoir arrangement) or for actively pumping in additionally needed fluid.

As such, the above higher technology systems require various motors, pumps, valving systems, sensory feedback arrangements, and control systems for all the foregoing. Due to their complicated construction and design, such beds are typically very expensive as to initial purchase or rental cost. They can also be complicated and expensive to maintain due to the prospect of frequent failure of numerous moving mechanical parts, and due to the extensive training which an operator or maintenance person would be required to undergo.

Also, there is the prospect of highly undesired heat transfer to a patient, due to operation to the above-referenced motors, pumps and other systems. Still further, the construction and design of such overall systems often require specialized bed frames not otherwise usable with typical mattresses.

The disclosures of the above-referenced United States Patents are fully incorporated herein by reference, all of which such Patents are commonly assigned.

SUMMARY OF THE INVENTION

The present invention is intended to recognize and address various of the foregoing problems, and others, concerning pressure relief systems and methodologies. Thus, broadly speaking, a principal object of this invention is improved pressure relief seating systems and methodologies. More particularly, a main concern is improved self-adjusting technology without requiring the expense and complexity of relatively higher technology.

One main general object is to provide an improved self-adjusting pressure relief seating system, applicable to numerous different seating or at rest conditions, in either medical and consumer settings.

It is, therefore, another particular object of the present invention to provide apparatus and methodology which achieves the performance advantages of a dynamic fluid-based system, but at the same time without requiring the complicated and expensive constructions and designs typical of previous systems.

It is thus another general object of the present invention to provide a self-adjusting system which is capable of relying on the use of potential energy. Hence, a more particular object is to provide such an improved system and methodology which does not require the use of external energy. More specifically, it is a present object to avoid the need for sensory feedback control systems, and/or systems for controlling pump and valving systems, but while also still providing a dynamic fluid-based system.

Another present general object is to provide a fully self-adjusting pressure relief system which optimizes pressure dispersion, while still using a relatively inexpensive and simple design so as to obviate the need for motors, control systems, or specialized frames or training associated with its use and maintenance.

Yet another object is to provide a pressure relief support system which is self-adjusting to allow for more even weight distribution, thereby improving the reduction of pressure on the tissue and skin of a user. At the same time, it is an object to provide a self-adjusting technology which may be customized, as desired, for different patient uses, and for different alternate uses.

Still another general object is to provide the advantages of resilient pressure relief obtained from resilient foam combined with a self-adjusting fluid pressure relief system.

More specifically, it is a present object to provide a self-adjusting pressure relief technology which is usable in a variety of settings. Specifically, it is intended to provide such self-adjusting technology usable in both medical and commercial fields, including all seating technologies, as well as others. In the area of medical uses, it is intended to provide a system and improved technology which is usable in space critical circumstances, such as involving medical seating systems of all types, such as wheelchairs or geriatric chairs.

It is another present object to provide a self-adjusting technology with the advantages of active (i.e., dynamic) fluid-based systems, but with such simplicity that the technology may be extended to every day consumer products, such as ergonomic chairs and car seats.

It is a still further object of the present invention to provide a technology capable of being customized to provide specialized support surfaces, such as for pregnant women, or for amputees or other persons requiring nonconventional support needs for sitting, or with use in specialized vehicles, such as heavy transports, military vehicles, or heavy equipment.

Still further, it is a present object to provide improved technology applicable in a broad sense virtually to any circumstance of bodies in rest. For example, such technology may be incorporated into specialized pillows, such as in the case of head injuries involving swelling or other weight changes. Likewise, the present technology would be equally applicable to packaging arrangements (such as for fragile equipment) where it is desired to minimize or limit pressures associated with transfer shock or the like.

Additional objects and advantages of the invention are set forth in or will be apparent to those of ordinary skill in the art from the detailed description which follows. Also, it should be further appreciated that modifications and variations to the specifically illustrated and discussed features, steps or materials hereof may be practiced in various embodiments and uses of this invention without departing from the spirit and scope thereof, by virtue of present reference thereto. Such variations may include, but are not limited to, substitution of equivalent means and features, materials or steps for those shown or discussed, and the functional or positional reversal of various parts, features, steps, or the like.

Still further, it is to be understood that different embodiments, as well as different presently preferred embodiments, of this invention may include various combinations or configurations of presently disclosed features, steps, or elements, or their equivalents (including combinations of features or steps or configurations thereof not expressly shown in the figures or stated in the detailed description). Also, it is to be understood that various features from one embodiment, as illustrated, discussed or suggested, may be combined with or substituted for features of other disclosed or suggested embodiments, within the spirit and scope of the present invention.

One exemplary embodiment of the present invention relates to a self-adjusting pressure relief seating system. Such system may comprise a particular main support body and a constant force fluid reservoir means. Such main support body is provided for receiving a person generally seated thereon, and has at least one adjustable resilient support bladder with fluid and resilient foam therein. Multiple support bladders may be used in additional embodiments and various forms of support bodies and seating arrangements may be practiced throughout all such embodiments.

The above-referenced constant force fluid reservoir means is preferably provided in fluid communication with the resilient support bladder. Such fluid reservoir means is operative for automatically adjusting the bladder so as to maintain a generally constant predetermined internal pressure in such bladder responsive to changing loading on the main support body.

The foregoing system and corresponding methodology is equally applicable to various sectionalized support arrangements with multiple independently acting support sections, as further described herein.

Another present exemplary embodiment concerns a self-adjusting pressure relief patient seating support system for use with a wheelchair. Such a system may comprise a particular main support body and a pair of constant force fluid reservoir means mounted therebelow.

Such support body is adapted for receiving a patient generally seated thereon, and has at least two adjustable fluid support bladders with fluid therein. The pair of constant force fluid reservoir means are in respective fluid communication with such fluid support bladders. Such means functions for automatically adjusting the bladders using potential energy so as to maintain a generally constant predetermined internal pressure respectively in each of such bladders responsive to changing patient loading on the main support body.

In such embodiment, the pair of constant force fluid reservoir means preferably each include a reservoir and pivoting actuation plate functionally operative therewith. The plate is preferably located for pivoting from adjacent a lateral side of the wheelchair so that the pivoting free ends of such plates are towards the middle of the wheelchair beneath the main support body. In such fashion, operation of the constant force fluid reservoir means (i.e., pivoting of the actuation plates) does not interfere with structural supports of the wheelchair.

Yet another construction comprising a present exemplary embodiment relates to a sectionalized seating support arrangement with multiple independently acting support sections. Such arrangement preferably includes a main support body having a predetermined arrangement of independently adjustable resilient chambers, and a plurality of constant force fluid reservoir means. The resilient chambers each have fluid and resilient foam therein. The chamber shapes and sizes define corresponding independently acting support sections.

The reservoir means of the above embodiment are each respectively in fluid communication with a respective one of such chambers, for automatically adjusting such chamber using potential energy. In such fashion, a generally constant predetermined internal pressure is maintained in each respective chamber responsive to changing loading on the main support body.

Preferably in the foregoing embodiment, the main support body comprises a seating arrangement including one of a wheelchair, a geriatric care chair, a specialized patient care chair, an ergonomic chair, and a seat in a transportation vehicle (which could assume numerous different forms).

It is to be understood that the present invention also relates to corresponding methodologies, as should be understood and as explicitly disclosed herein.

For example, one such methodology relates to a self-adjusting pressure relief seating system methodology. Such method relates to the steps of providing a main support body for receiving a person generally seated thereon, and having at least one adjustable resilient support bladder with fluid and resilient foam therein. The method further relates to providing a fluid reservoir in fluid communication with such resilient support bladder and with constant force applied thereto utilizing potential energy. In such fashion, the bladder is automatically adjusted so as to maintain a generally constant predetermined internal pressure in the bladder responsive to changing loading on the main support body. Additional steps and features of such methodology are discussed herein.

In still further exemplary embodiments of the subject invention, a patient seating support system is provided for use with a wheelchair of the type having lateral support rails for attachment of such system thereto and with wheelchair support braces therebeneath. Such a system preferably comprises in combination a support base, at least three independently adjustable resilient support chambers, and at least a pair of constant force fluid reservoir means.

Preferably in such embodiment, the support base is provided with attachment means for securement thereof in a generally horizontal position on a wheelchair. The support chambers are preferably received on an upper surface of the support base. Each such chamber comprises an air-tight sealable envelope with fluid and resilient foam therein. Each chamber has a fluid interconnection port for accessing the interior thereof. Also, such three chambers are preferably disposed on the support base upper surface in generally left, right, and rear central positions thereon.

The above-referenced reservoir means are preferably received on a lower surface of the support base, and in fluid communication with the ports of the at least two support chambers. The reservoir means automatically adjust such at least two chambers so as to maintain a generally constant predetermined internal pressure in such two chambers responsive to changing patient loading.

Still further, such particular reservoir means each preferably include a reservoir and associated pivoting actuation plate mounted beneath the support base so as to pivot towards the central portion of such base, so as to avoid interference with the support braces of the wheelchair.

Yet further, another exemplary construction relates to a patient seating support system for use with a wheelchair, including a support base, at least one independently adjustable resilient support chamber, and a particular backpack means. In such embodiment, the support base is provided for receipt on a wheelchair. The at least one support chamber is received on such base for in turn receiving a patient on the chamber. The chamber preferably comprises an air-tight sealable envelope with fluid and resilient foam therein, and having a fluid interconnection port for accessing the interior of such chamber.

The aforementioned backpack means are preferably carried on the back support of the wheelchair, and include at least one constant force fluid reservoir means provided in fluid communication with the support chamber. Such reservoir means function for automatically adjusting such chamber so as to maintain a generally constant predetermined internal pressure therein responsive to changing loading.

It is to be understood that the subject invention also relates to and encompasses corresponding methodologies, also as discussed herein. Those of ordinary skill in the art will better appreciate the features and aspects of such embodiments, methods and others, upon review of the remainder of the specification.

BRIEF DESCRIPTION OF THE DRAWINGS

A full and enabling disclosure of the present invention, including the best mode thereof, directed to one of ordinary skill in the art, is set forth in the remainder of the specification, which makes reference to the appended figures, in which.

Figure 1:
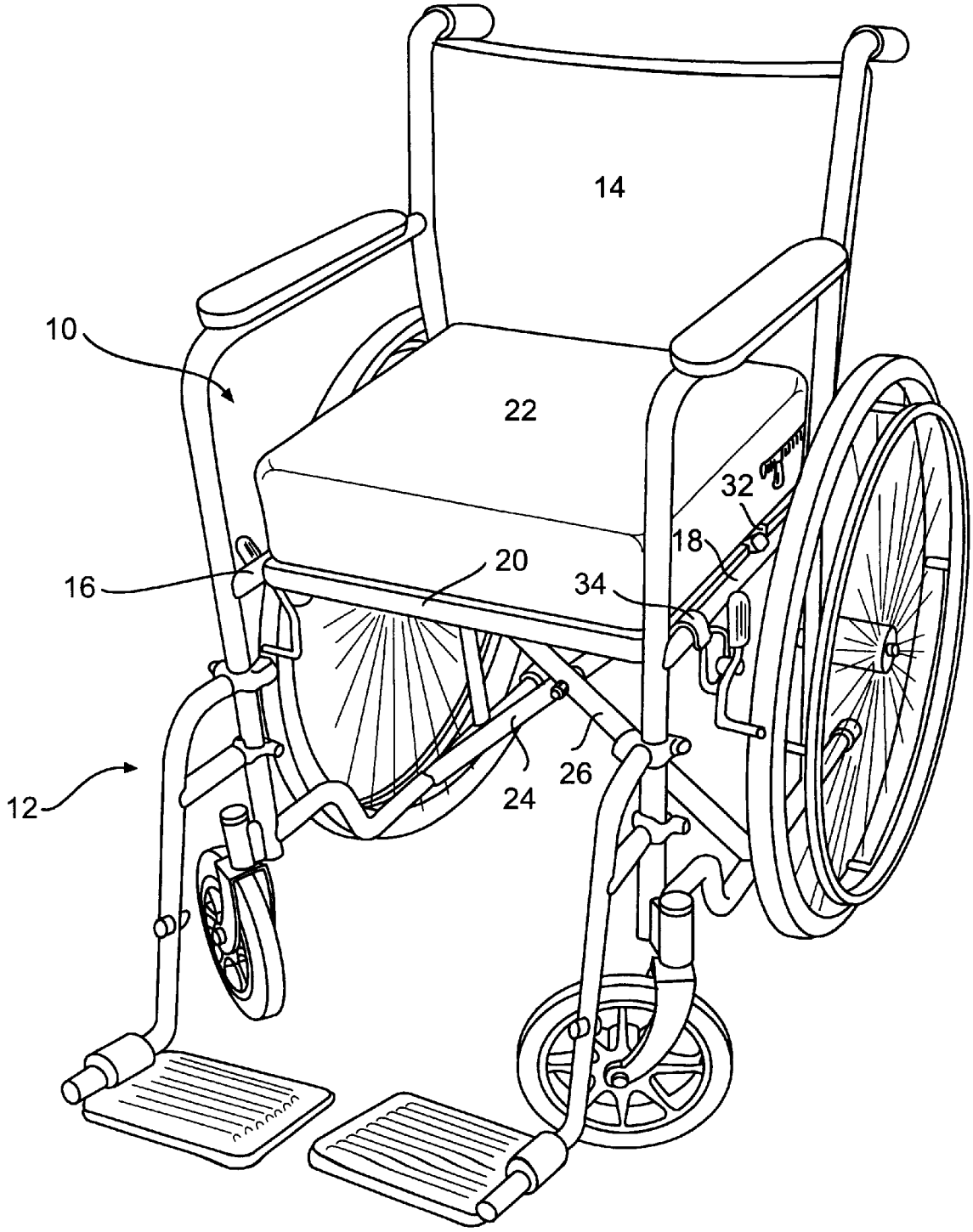
FIG. 1 is a perspective view of a first exemplary embodiment of the present invention illustrating use thereof with an exemplary conventional wheelchair.

Repeat use of referenced characters throughout the present specification and appended drawings is intended to represent same or analogous features, elements, or steps of the invention.

DETAILED DESCRIPTION OF THE PREFERRED EMBODIMENTS

Based on the complete disclosure herewith, and including the materials incorporated herein by reference from the parent application U.S. Ser. No. 08/253,982, those of ordinary skill in the art will appreciate that there are many different embodiments of the subject invention, including both systems, apparatus, and methodology. The following discussion considers certain specific examples thereof, but such discussion is not intended to otherwise diminish the complete scope of the present subject matter.

FIGS. 1 through 8 represent a detailed example of a first exemplary embodiment of the subject invention, wherein a main support body generally 10 is provided for use with a conventional wheelchair generally 12, of well known construction. This embodiment represents the facility of the present invention to be retrofit to existing medical equipment, thereby upgrading health care or user ergonomics in a very efficient manner. It is also intended to represent the potential for intermixing aspects of the present invention with preexisting components, such as air bladders, foam pads, or zippered covers.

As understood, a patient sits in wheelchair 12 with their back to back support 14, while the buttocks and upper legs are supported on devices typically attached to or supported by side rails 16 and 18, or front rail 20 and a rear rail (not shown). In this instance, a main support body 10 in accordance with the subject invention has been affixed or supported on side rails 16 and 18, so that a new upper surface generally 22 is provided in accordance with the subject invention for a person to be generally seated thereon.

As otherwise well known, the exemplary conventional wheelchair 12 of present FIG. 1 may include lower support or cross braces such as generally 24 and 26, which physically limit the amount of space immediately below main support body 10 of the subject invention. As shown in FIGS. 1, 2, 5, and 8, a main support base generally 28 of the subject invention is provided with specific features, such as notches 30 and 32, for accommodating cross braces generally 24 and 26 of wheelchair 12.

Figure 5:
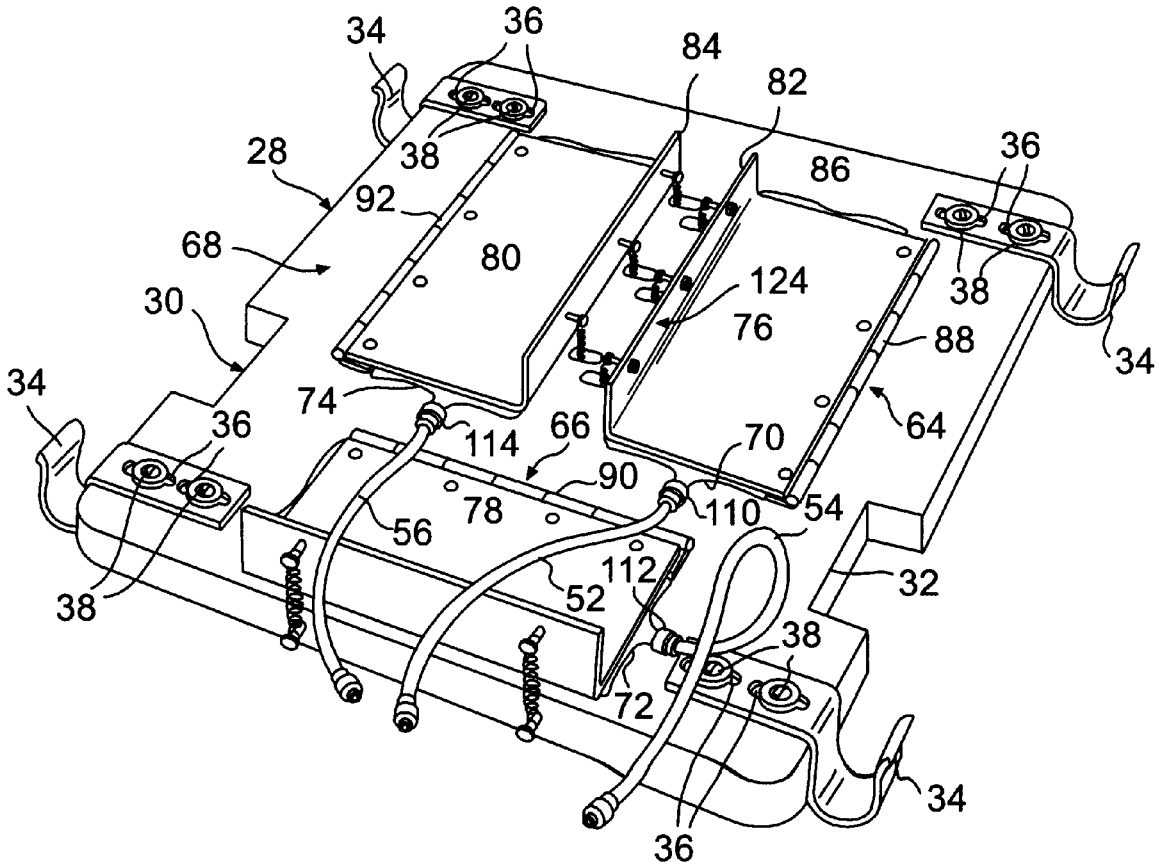
FIG. 5 is a generally bottom perspective view of a main support member of the embodiment of present FIG. 2, further illustrating independent self-adjusting components supported thereon.

Rail hooks 34 or equivalent devices may be used for ready securement, i.e., means for attachment, of the subject main support body 10 to the structural support features existing for wheelchair 12 (i.e., side rails 16 and 18). FIG. 5 is a generally bottom perspective view of support base 28, and illustrates slots 36 which may be provided in connection with attachment means 34, and used in connection with washer/screw sets 38 in order to adjust the positions of hooks 34. Such arrangement helps facilitate use of the subject invention with different size wheelchairs. Rail spacings such as between 14 and 16 inches are fairly common, and it is intended that this embodiment of the subject invention be adapted to operate in and near such ranges, for use with many conventional wheelchairs. As is readily apparent, the subject invention may be practiced with widths smaller or greater than the above exemplary dimensions. All such modifications are intended to come within the spirit and scope of this invention.

Figure 8:
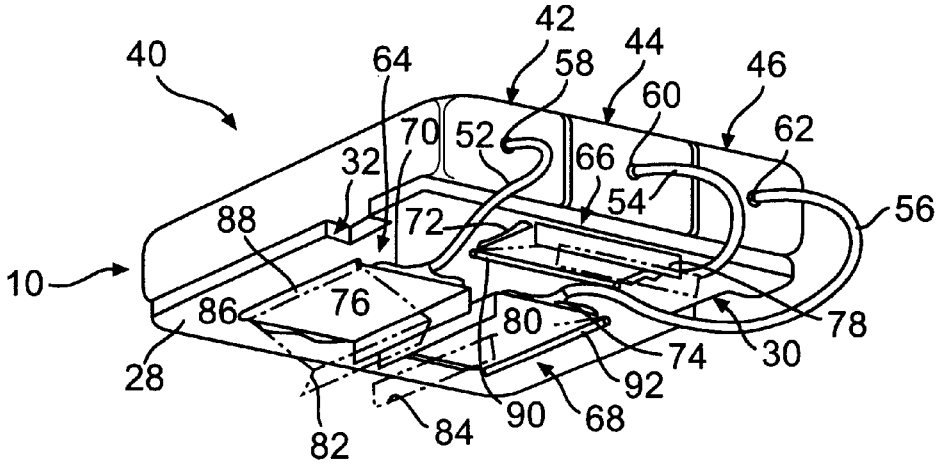
FIG. 8 is a generally rear and bottom perspective view of the components of present FIG. 2, assembled but with the exterior cover thereof removed.

FIG. 8 illustrates a generally rear and bottom perspective view of an exemplary self-adjusting pressure relief seating system generally 40 in accordance with the subject invention. Main support body generally 10 thereof has at least one adjustable resilient support bladder with fluid and resilient foam therein. The particular embodiment illustrated makes use of three such adjustable fluid support bladders, generally 42, 44, and 46.

Figure 2:
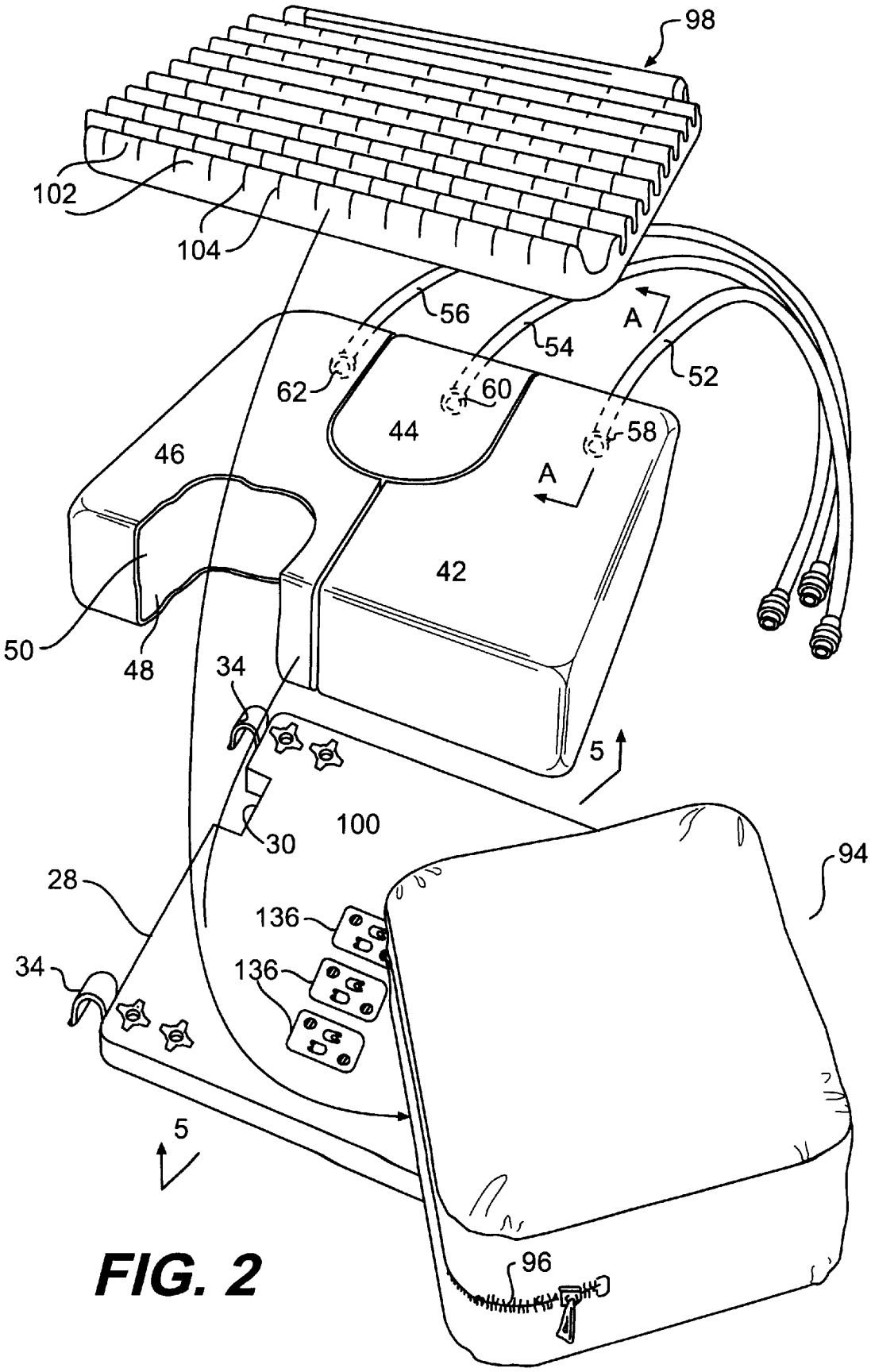
FIG. 2 is an exploded and partially disassembled view of the exemplary embodiment of present FIG. 1, with partial cutaway illustrations.

FIG. 2 represents a generally top perspective view of such support bladders 42, 44, and 46, separated from other features of the main support body 10 with which they would normally be used. Also, bladder 46 is represented in partial cutaway so as to indicate the interior resilient foam generally 48 utilized inside of plastic envelope or similar 50. Preferably, a generally open-celled foam is utilized, so that there is free movement of fluid (for example, air) throughout chambers 42, 44, and 46.

Each such chamber has respective fluid interconnections with other elements in accordance with the subject invention, utilizing, for example, plastic tubing 52, 54, and 56. Each of such tubes may have suitable fittings associated with respective fluid interconnection ports 58, 60, and 62. Virtually any form of couplings, quick disconnects, plastic tubing, and the like may be utilized, as generally commercially available, and of varying diameters such as ¼ to ¾ inch. One supplier of such couplers and tubing is Colder Products Company of St. Paul, Minn. Details of such couplings and tubing form no particular aspect of the subject invention, apart from their general use as illustrated herein, and for the specific functions as disclosed.

The generally bottom perspective views of both FIGS. 5 and 8 represent constant force fluid reservoir means which may be provided in accordance with the subject invention in fluid communication with the respective resilient support bladders, for automatically adjusting such bladders (respectively) so as to maintain a generally constant predetermined internal pressure in such respective bladders responsive to changing loading on the main support body 10. In different embodiments of the subject invention, different numbers of the support bladders 42, 44, and 46 (or other numbers of support bladders where different numbers of such components are utilized) may be interconnected (such as with Y or T connectors) to the constant force fluid reservoir means. In further embodiments of the subject invention, some support bladders may instead be left unconnected so as to freely communication with ambient air pressure, such that the resilient foam within such bladder solely provides support for the portion of a patient received thereon.

As represented in each of FIGS. 5 and 8, at least in some embodiments of the present invention, three constant force fluid reservoir means may be provided for respective interconnection and function with three respective bladders 42, 44, and 46. Such reservoir means, generally 64, 66, and 68, respectively, may assume different forms of components for automatically adjusting its corresponding bladder so as to maintain a generally constant predetermined internal pressure therein. For example, the parent application U.S. Ser. No. 08/253,982 incorporated herein by reference discloses various alternatives which may be combined herewith in accordance with the subject invention.

In the illustrated embodiments, preferably each such constant force fluid reservoir means includes a reservoir (70, 72, and 74), and a pivoting actuation plate (76, 78, and 80) functionally operative therewith. For two of such arrangements (plates 76 and 80), the plate pivots from adjacent a lateral side of the wheelchair so that the pivoting free ends 82 and 84 of such plates are towards the middle of the wheelchair beneath the main support body 10 so as to not interfere with structural supports of wheelchair 12 (such as cross braces 24 and 26 thereof).

FIG. 5 illustrates all pivoting plates in an at rest position, fully closed, and with their respective reservoirs 70, 72, and 74 fully deflated. FIG. 8 likewise represents the same condition in solid lines, and represents in dotted line position relative inflation of corresponding bags 70, 72, and 74, with all three pivoting plates moved outwardly from the lower surface 86 of support base 28.

As shown (FIGS. 5 and 8), hinges 88, 90, and 92 may be mounted on such bottom surface 86 of support base 28. Support base 28 may be wood or other material into which screws, bolts, rivets, or the like may be readily received for securing such hinges. Other forms of pivoting arrangements, or different constant force fluid reservoir means in accordance with the subject invention (and including the parent application hereof) may be practiced.

As further represented by present FIG. 2, a removable cover generally 94 may be provided, and include a zipper 96 or similar for convenience in removing such cover from around support bladders 42, 44, and 46. Cover or case 94 may comprise, for example, elastic knit or other forms of material, such as liquid resistant or repellant. Also, a resilient foam pad generally 98 may be included within zippered case 94, all for residing on the upper surface generally 10 of support base 28. FIG. 2 merely represents one presently preferred, and exemplary, embodiment of such a foam pad 98 which may be utilized. Such pad in this example has independent cells 102 formed by a plurality of cuts 104 in the foam. Numerous alternatives may be practiced. For example, see various foam configurations as represented in U.S. Pat. No. 4,862,538, the complete disclosure of which is fully incorporated herein by reference.

Figure 4:
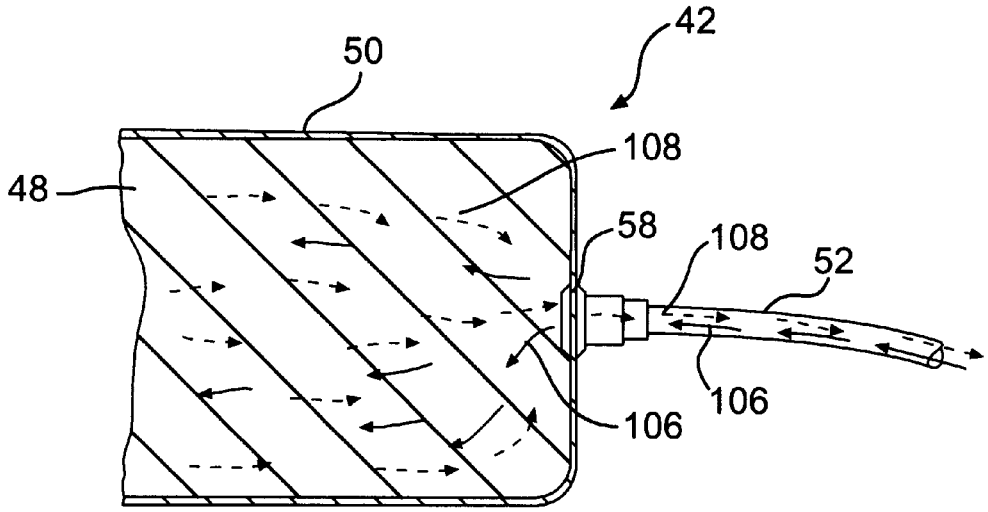
FIG. 4 is a relatively enlarged, cross-sectional view of a portion of one of the exemplary independently adjustable support chambers of present FIG. 2, as taken along the sectional line 4—4 indicated in such FIG. 2.

FIG. 4 illustrates a generally enlarged cross-sectional view of independently adjustable support chamber 42, taken along the sectional line 4—4 appearing in present FIG. 2. As seen, fluid communication (for example, air) is achieved via tubing 52 and port 58. Resilient material, such as open-celled foam generally 48 is received inside of otherwise air impermeable material 50, such as a vinyl or plastic envelope type material. As shown by the solid arrows generally 106 and the dotted line arrows generally 108, fluid such as air may be alternately introduced into and removed from, respectively, support bladder 42. In such fashion, the adjustability (i.e., inflation) of bladder 42 is maintained separate and independent from that of bladders 44 and 46. At the same time, the presence of resilient foam material 48 within the respective bladders gives a degree of support based thereon, without regard to additional support or adjustments which may be introduced via respective fluid interconnection tubings 52, 54, and 56.

The respective foam characteristics, or other characteristics associated with respective support bladders may be varied among such bladders to obtain particular results or for forming different embodiments. In other words, different bladders may have different characteristics, yet be combined together in a single embodiment.

Figure 3:
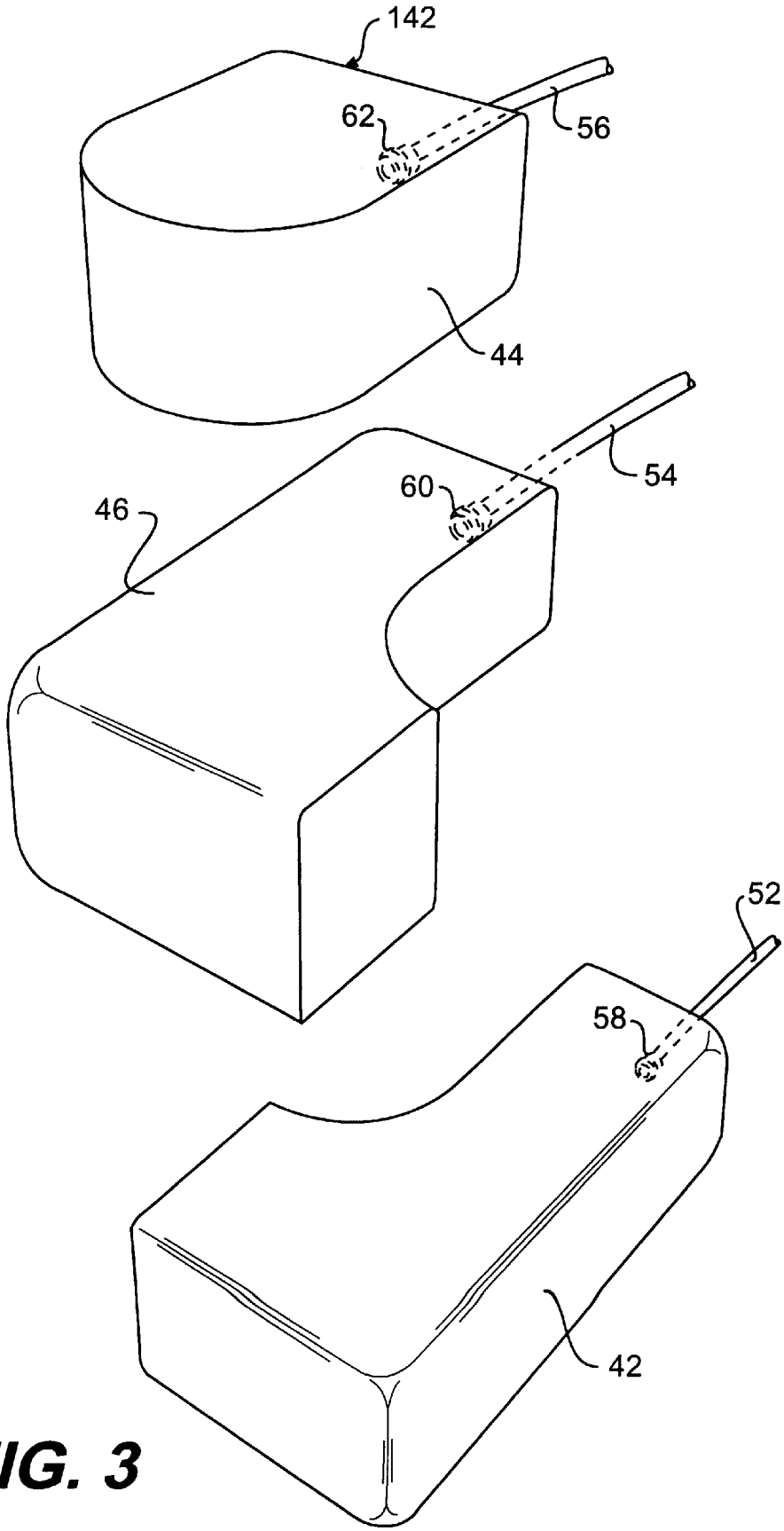
FIG. 3 is an exploded view of the exemplary independently adjustable support chambers of the exemplary first embodiment of present FIGS. 1 and 2.

It is to be likewise understood from practice of the subject invention that different arrangements and different numbers of such support bladders may be provided, to create corresponding independent plural support sections. The illustration of present FIGS. 2 and 8 represent use of left, right, and generally rear central positions of a three support bladder system. FIG. 3 represents such three support bladders (42, 44, and 46) in generally exploded view, to show additional detail in the respective shapes thereof. It is to be understood that various shapes may be practiced, generally without specific limitations, so long as desired support characteristics are otherwise provided in accordance with the subject invention for a particular seating configuration.

Figure 6:
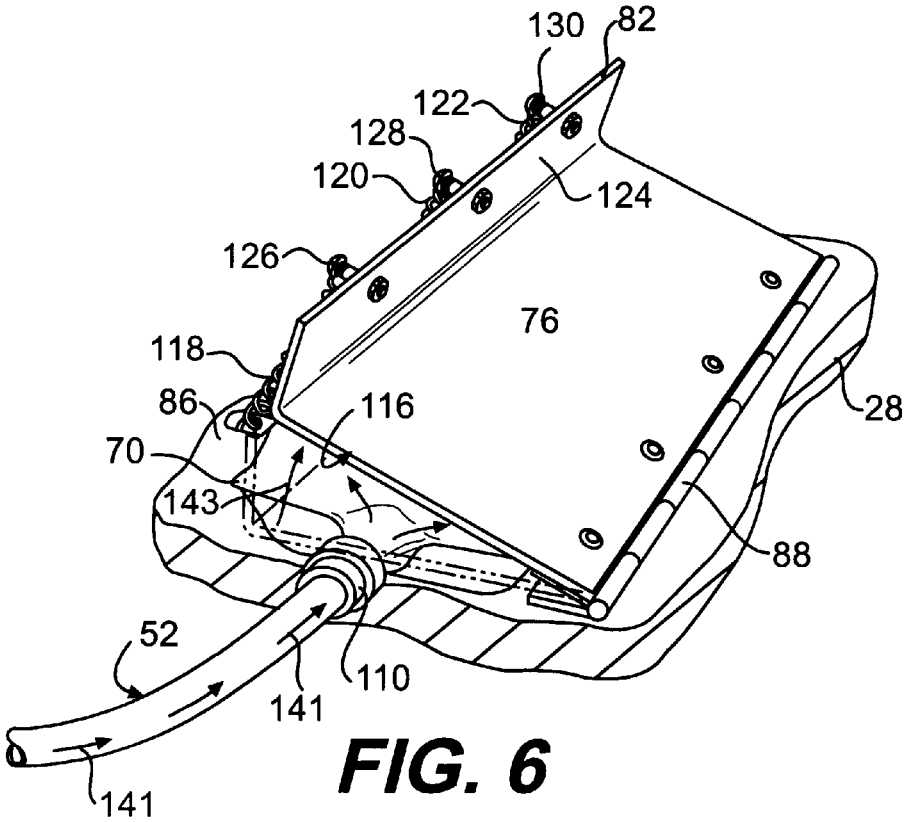
FIG. 6 is a relatively enlarged, isolated view of one of the exemplary self-adjusting components of present FIG. 5, representing dynamic response thereof, supported on the bottom of a main support member.
Figure 7:
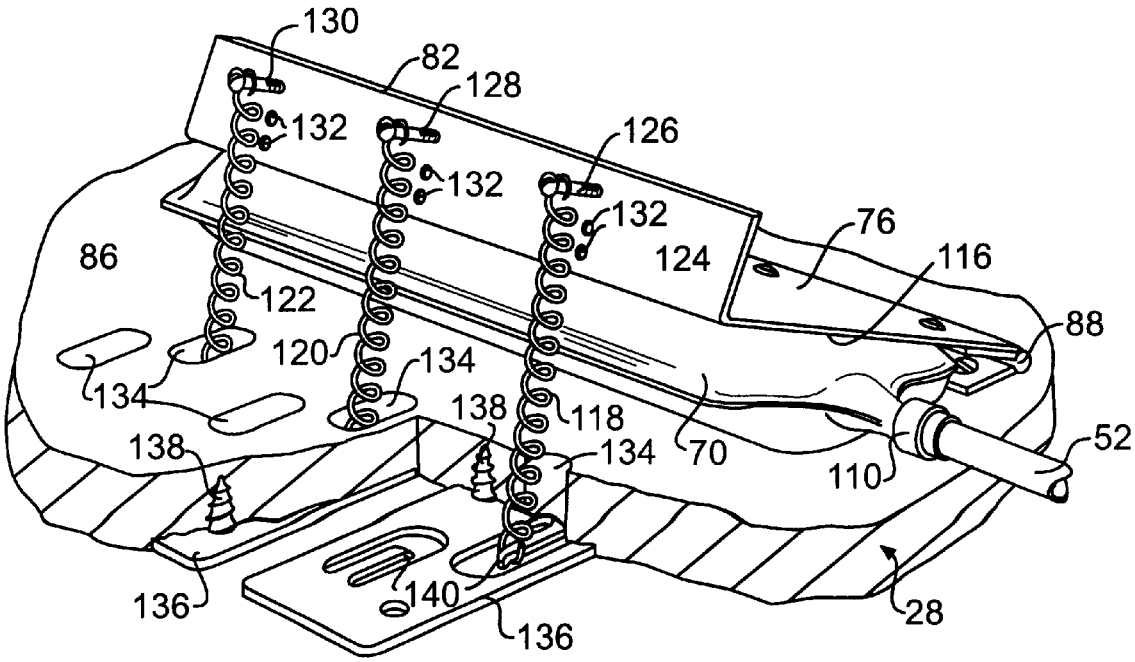
FIG. 7 is a generally bottom perspective view, in partial cutaway, of the main support member and independent self-adjusting component illustrated in present FIG. 6, showing additional features of the subject invention in connection with mounting and operation of such self-adjusting component.

FIG. 6 represents a generally enlarged, partially cutaway view of the features of FIG. 5 relative to pivoting actuation plate 76 and reservoir 70 thereof. The view of FIG. 6 is primarily taken from a side perspective showing hinges 88 thereof, while a somewhat reverse view of the same subject matter is shown by present FIG. 7, illustrating additional detail, as discussed hereinafter.

As shown by FIG. 5, each of reservoirs 70, 72, and 74 include associated coupling elements 110, 112, and 114, cooperative with respective tubings 52, 54, and 56. As shown in great detail in FIGS. 6 and 7, reservoir 70 is preferably trapped between the lower surface 86 of support base 28 and the upper surface generally 116 of pivoting actuation plate 76. Typically, friction engagement of reservoir 70 will be adequate, without requiring any glue or similar holding elements. Coupling member 110 resides free from the operation of actuation plate 76, for the protection thereof.

As otherwise illustrated, an arrangement is provided for the use of the potential energy of springs 118, 120, and 122. The collective spring force of such constant force spring means is adjustable in a variety of ways. First of all, the free or pivoting edge 82 of pivoting actuation plate 76 may be provided as an upturned flange generally 124. Such flange may include bolts, screws, or the like 126, 128, and 130 positioned in selected openings in flange 124. As otherwise seen (FIG. 7), additional openings generally 132 may be provided, so that the respective springs 118, 120, and 122 may be placed at different lengths for a given position of pivoting plate 76 relative to surface 86 of support base 28.

The opposite ends of constant force springs 118, 120, and 122 may be received through various openings generally 134 formed for such purpose through support plate 28. Particularly formed metal elements 136 or the like may be secured (for example, screws 138 into support base 28), and provided with cantilevered or similar metal elements 140, upon which such opposite ends of springs 118, 120, and 122 may be secured. With such an arrangement, those of ordinary skill of the art will readily appreciate that the potential energy of such collective constant spring forces is utilized to provide a force tending to close pivoting actuation plate 76 towards surface 86 of support base 28 with reservoir 70 squeezed therebetween. With fluid communication to support bladder 42 provided by tubing 52, port 58 and coupling 110, changing forces on support bladder 42 may be counteracted or accommodated until equilibrium is reached with the combined arrangement of bladder 70, springs 118, 120, 122, and the elements functionally involved in such features.

For example, arrows 141 show a flow of fluid (such as air) into reservoir 70 via tubing 52 and coupling 110 as additional force (e.g., weight) is received on an associated support bladder (e.g., 42). Since bladder 42 is a right side bladder (looking down on the device from its front), such an increase could occur, for example, whenever a patient initially sits on wheelchair 12, or shifts their weight, such as by raising their opposite (right) leg or by adjusting their position. As reservoir 70 expands, actuation plate 76 pivots in the direction of arrow 143, opposite to the forces of springs 118, 120, and 122 acting thereon until a new equilibrium position is achieved (i.e., until plate 76 stops moving). Operation is generally reversed whenever weight on exemplary support bladder 42 is reduced, as will be understood by those of ordinary skill in the art from the disclosure herewith.

In the foregoing arrangement, the capacity of the reservoirs 70, 72, and 74, the density of the resilient foam within the support bladders 42, 44, and 46, and the spring force of the constant force springs, are all predetermined so as to maintain a generally constant predetermined internal pressure for the support bladders responsive to changing loads thereon. For example, the following may be practiced: a reservoir capacity in a range of from about 0.5 liters to about 2.0 liters; a density of the resilient foam of said support bladders from about 1.0 pounds per cubic foot to about 5.0 pounds per cubic foot, and a spring force from about 1.5 pounds per inch to about 6.0 pounds per inch.

Variations of all such characteristics may be mixed in a given embodiment of the subject invention.

Likewise, different values may be practiced for the dimensions of various components. With reference to support bladders 42, 44, and 46, a collective support surface region may be provided, for example, about 18 inches wide and 16 inches deep, and about 3 inches thick. In such exemplary embodiment, the rear central bladder 44 may be about 8 inches wide at the rear base thereof (142 of FIG. 3) and about 7 inches long from such base 142 to the curved point thereof near the middle of the main support body 10. Other dimensions, shapes, and sizes of support bladders may be practiced. Also, different numbers of support bladders may be practiced, some disconnected entirely from reservoir means in accordance with the subject invention, or all respectfully connected with such means, or some interconnected for fluid communication with other bladders and such reservoir means.

Various materials may be practiced in accordance with the subject invention. For example, the bellows or pivoting actuation plates 76, 78, and 80, may be formed from aluminum as may be the elements generally 136 (FIGS. 2 and 7) to which the ends of springs 118, 120, 122 (and others) are secured.

Varying the total spring force involves altering the collective spring force of springs (such as 118, 120, and 122) associated with a single pivoting actuation plate (such as 76). Such changes may be accomplished by various means, for example, by changing the strength of the respective springs, by changing the number of the respective springs, or by changing the location of screws, or other elements to which the springs connect (i.e., to vary the at rest length of the springs).

Still further adjustments may be made in connection with the present invention, such as relocating various cutouts or notches 30 and 32 for accommodating cross bracing of particular wheelchair constructions.

Considering a particular example of the three support bladder arrangement of present FIG. 2 and other figures of the first embodiment, the following discussion is provided. An exemplary foam of two pounds per cubic foot density and 35 pounds indentation load deflection (ILD) may be provided. As understood, density and ILD characteristics may be varied, in keeping with the broader aspects of this invention. All three bladders may make use of quarter inch sealed nipples with no separate valving. Some internal threads for gripping any insert may be provided. Individual bladders may be sealed in any suitable air tight fabric, such as a PVC coated nylon fabric, with heat sealed panels.

Each bladder may be separately connected to an automatic adjusting means structure or other source, or some left unconnected. The ischial section (such as support bladder 44) may ideally be "floated" (i.e., open to ambient air pressure), or arranged for fluid interconnection with another support bladder, or one of the reservoir means directly.

In a version making use of two reservoir means interconnected with the respective left and right support bladders 42 and 46 (with rear central bladder 44 "floated"), one liter medical bags (such as standard IV bags) may be utilized. Similarly, three or four springs (FIGS. 5 or 9) of 1.5 pounds per inch (nominal) spring force may be utilized with each respective pivoting plate. In the example of present FIG. 9 (which is a generally bottom perspective view of a further embodiment in accordance with the subject invention) the size of pivoting plates 144 and 146 are roughly 50% larger than those of pivoting plates 76 and 80 (FIG. 5), to likewise accommodate generally 50% larger reservoirs 148 and 150, respectively. In general, all other elements of FIG. 9 (and related discussions thereof) may correspond with those of like indicated reference characters of present FIG. 5 and other related figures.

Figure 9:
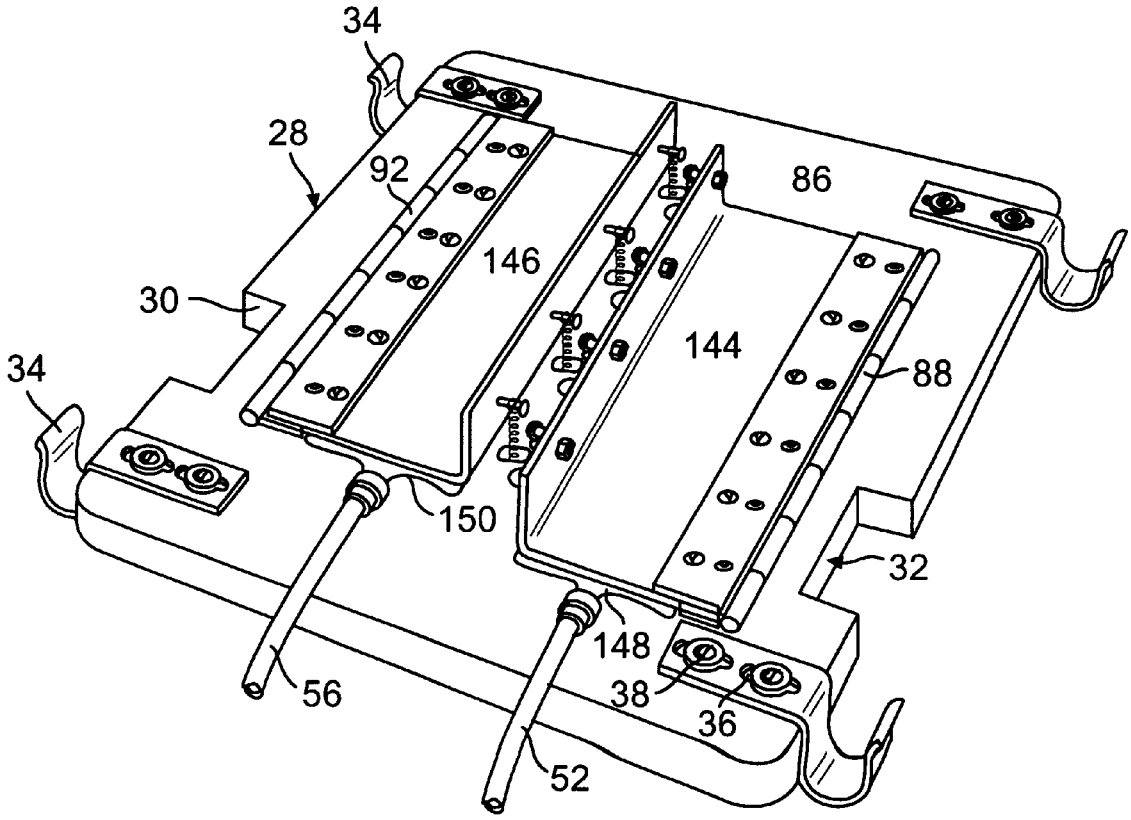
FIG. 9 is a generally bottom perspective view (similar to that of present FIG. 5) representing an exemplary main support member and independent self-adjusting components in accordance with a second exemplary embodiment of the subject invention, primarily usable with wheelchair embodiments thereof.

The chief distinction between the embodiments of present FIGS. 5 and 9 are the use of different numbers of reservoir means, their particular interconnection with support bladders, the sizes of the structural elements, and the number of spring elements involved with each pivoting plate (three each for FIG. 5 and four each for FIG. 9). Otherwise, in principle, the discussions related to the features of present FIGS. 1 through 8 are fully applicable to the embodiment encompassing the features illustrated in present FIG. 9, in combination with other features of the present invention, such as the main support body and adjustable support bladders or bladder thereof, a removable cover 94, and support pad 98.

In some embodiments, the structure and devices of, for example, present FIG. 9 may be interconnected with preexisting components such as wheelchair air bladders. Some of such devices have "bleed off" valves to which, for example, tubing 52 and 56 could be connected, so that automatic adjustments result during use.

In still further embodiments, support pad 98 may be provided approximately 1 inch thick, and with different cell structures of approximately 2 inches by 2 inches, or intermixed with 1 inch by 2 inch cell structures. The foam of pad 98 may be similar in characteristics to that included within supports 42, 44, 46, or may be different (as may be the foam within each of such supports). Typically preferred is an open cell type foam, which is air and water permeable. It might also be possible (or desired in some instances) in the case of pad 98 to use a sealed or closed cell foam piece which is not air or water permeable, especially if a covering is used which is air or water permeable.

The present form of seating arrangement could be used in environments other than wheelchairs, such as for truckers, automobiles, boats, geriatric chairs, and other different uses. When especially involved with wheelchair bound patients often having incontinence problems, the materials and interior foam inserts may be customized to account for such particular form of problem.

One aspect of the subject invention is that wheelchair patients particularly may not always have adequate sensation to know whenever a support arrangement is doing a good job of pressure relief. Accordingly, they do not know when themselves to make adjustments, and an automatic adjusting/balancing system such as disclosed is particularly advantageous in such circumstances.

Utilizing an arrangement where there are totally independent left and right side adjustments, regardless of interconnection of the center or ischial section, lifting one leg adds additional weight at the patient-to-support-surface interface of the opposite side, particularly on the front edge. Such action is reacted to, or compensated for, by a shift and fluid increase, such as to the rear of such particular bladder element. In effect, by operation of such an embodiment of this invention, the opposite side and the ischial section compensate to give an overall favorable feel of being drawn into the seat rather than an uncomfortable apprehension of beginning to roll out of the seat.

Also involving the present system and methodology, it is very easy to "zero out" the system at ambient room pressure, by using the quick disconnect air tube connectors referenced above. During original set up, or if a slow leak or similar were suspected, a patient could be removed from a wheelchair cushion, and the reservoir means disconnected, which would permit the foam inside the bladder to completely expand to its natural state under ambient pressure. At the same time, the reservoir means arrangement would completely damp down to a fully closed condition due to the spring tension referenced above. Thereafter, the system could be "reconnected" (i.e., the fluid interconnection reestablished). Similarly, a bleed off switch or vent to atmosphere could be used to the same effect in place of totally disconnecting the tubing.

The use of quick disconnects or similar features also permits the base unit and reservoir means elements to be utilized with other components, such as simple air bladders (i.e., without foam) available from other sources. The present invention is intended to encompass particular arrangements of such seating combinations, as well.

Figure 10A:
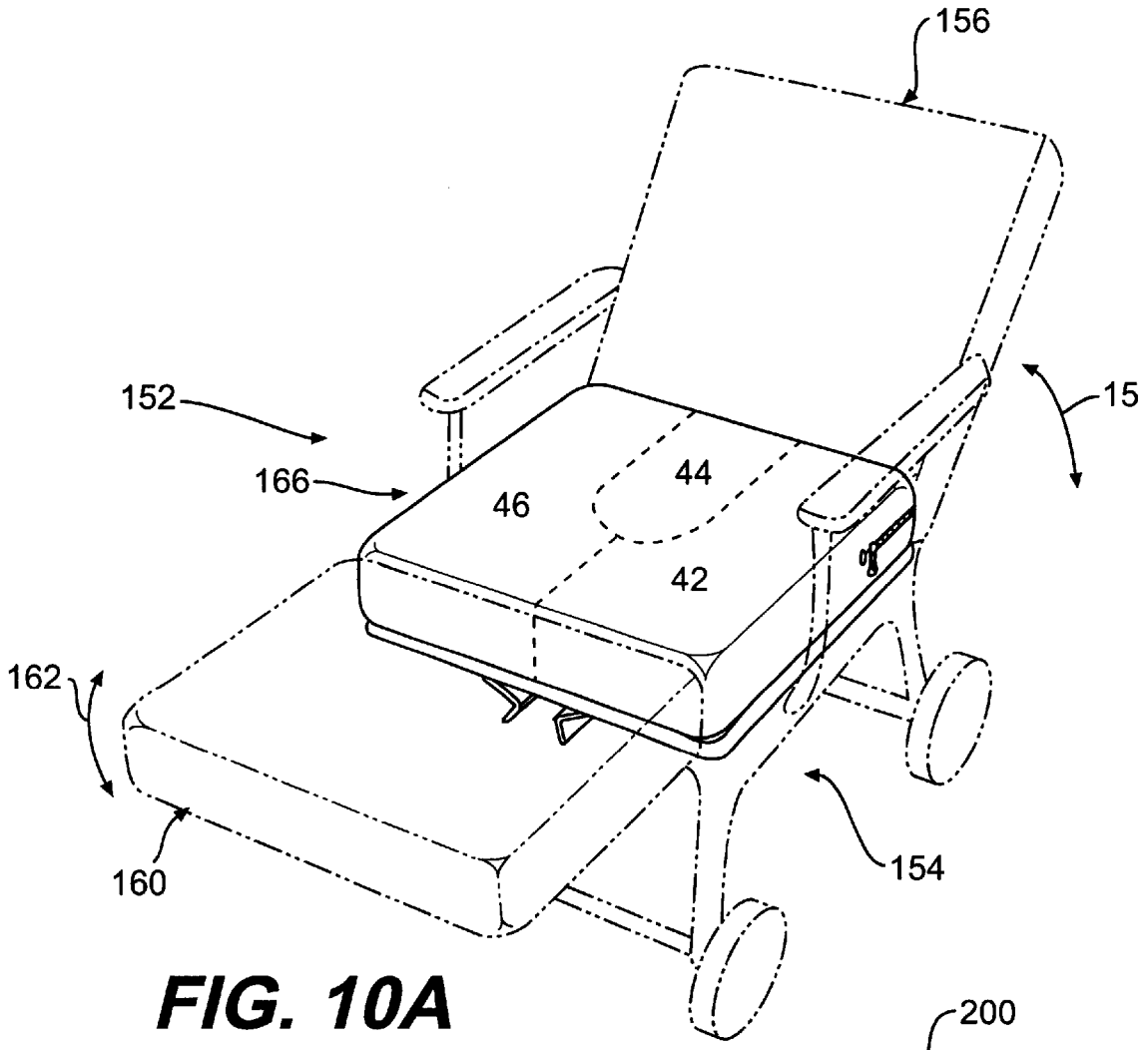
FIGS. 10A, 10B, and 10C, are respectively generally top perspective, longitudinal cross-section, and top plan views of an exemplary third embodiment in accordance with the subject invention, primarily illustrated for use with a geriatric chair.
Figure 10B:
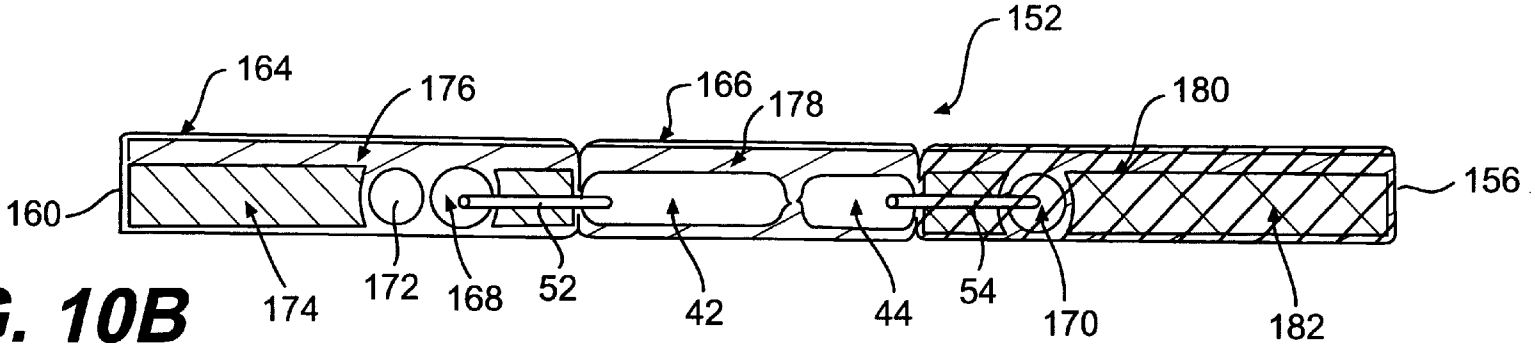
Figure 10C:
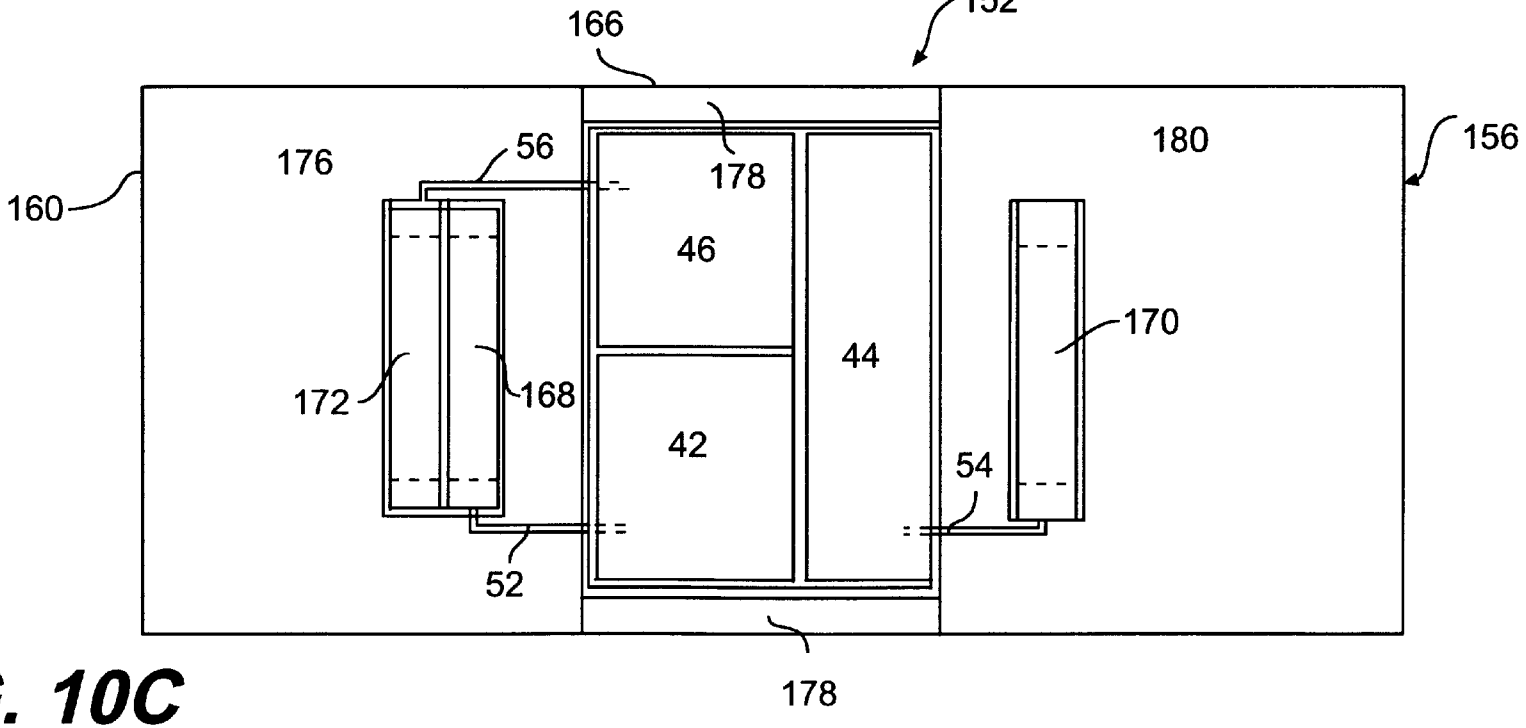

FIGS. 10A, 10B, and 10C represent generally top perspective, longitudinal cross-section, and top plan views, respectively, of a third embodiment, generally 152 in accordance with the subject invention. Such embodiment is provided integrated with an exemplary conventional geriatric care chair 154, a well known form of mobile chair, constituting primarily a variation on a wheelchair. For example, the geriatric chair 154 of present FIG. 1OA has a back generally 156, which may be raised or lowered generally in the direction of double headed arrow 158, and a lower or leg section generally 160, which also may be alternately raised or lowered generally in the direction of double headed arrow 162. A covering generally 164 may be provided over the various components of geriatric chair 154 (see FIG. 10B).

As represented primarily in dotted line in present FIG. 10A, embedded within central section generally 166 are respective independently adjustable support chambers in accordance with the invention. For the sake of illustration, a three support arrangement is shown in present FIG. 10A similar to that of present FIGS. 2 and 3, utilizing dotted line to represent separate bladders 42, 44, and 46. The top plan view of FIG. 10C is shown to a depth cutaway, so that three such resilient bladders 42, 44, and 46 are illustrated. Only two of such bladders are indicated in the longitudinal cross section of present FIG. 10B. Again, fluid interconnection tubing, such as plastic tubing 52, 54, and 56, may be utilized to connect such support bladders with fluid reservoir means generally 168, 170, and 172, respectively.

It will be understood from the illustrations of FIGS. 10B and 10C that different shaped and positioned support bladders may be utilized differently from that shown in FIG. 10A. For example, support bladder 44 is represented in present FIGS. 10B and 10C as residing generally laterally across the entire width of the rear of central section 166, which is different from the illustration of present FIGS. 10A and 2, in those exemplary representations. All such variations are intended to come within the spirit and scope of the present invention, by virtue of present reference thereto. Likewise, different numbers of support bladders may be practiced.

As further understood from the collective representations of FIGS. 10A, 10B, and 10C, the tubing and reservoir means associated with the respective support bladders are integrally incorporated into the geriatric care chair represented. Additional foam elements 174, 176, 178, 180, and 182 are illustrated, and may be utilized in conjunction with such an integral arrangement. In principle, such approach may be practiced in accordance with the subject invention in seating arrangements and circumstances different from geriatric care chairs. For example, FIG. 11 represents a generally front perspective view of yet another exemplary embodiment in accordance with the subject invention, integrally incorporated into a representation of a transportation vehicle seating arrangement 184.

Figure 11:
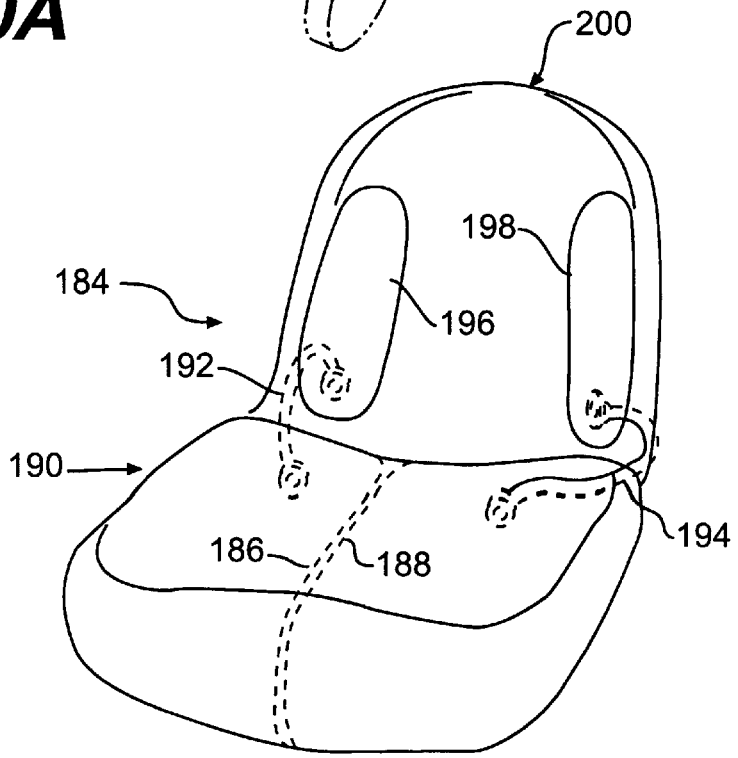
FIG. 11 is a generally front perspective view, in partial dotted line, of a fourth exemplary embodiment of the subject invention, representing use thereof in one potential transportation vehicle (e.g., car seat) arrangement.

Using dotted lines, it may observed in FIG. 11 that at least two separate support chambers 186 and 188 may be provided within a base region generally 190 of vehicle seat generally 184. Respective interconnecting tubing 192 and 194 is diagrammatically shown interconnecting with further components 196 and 198, respectively. Such components 196 and 198 diagrammatically represent several different alternatives.

First, such components 196 and 198 may be embedded within the upper seat portion generally 200, or may be received behind such upper seat portion 200. At the same time, such components 196 and 198 may represent further support bladders interconnected with bladders 186 and 188 respectively, for further interconnection to atmosphere or to reservoir means in accordance with the subject invention. At the same time, they may represent support bladders simply interconnected with one another, ultimately placed into equilibrium by the force of a passenger received simultaneously on seating portion 190 and seat back portion 200. Still further, components 196 and 198 may diagrammatically represent a form of reservoir means practiced in accordance with the subject invention, for functional interaction with support bladders 186 and 188, respectively. All such variations are intended to come within the spirit and scope of the present invention, but virtue of present reference thereto.

Figure 12:
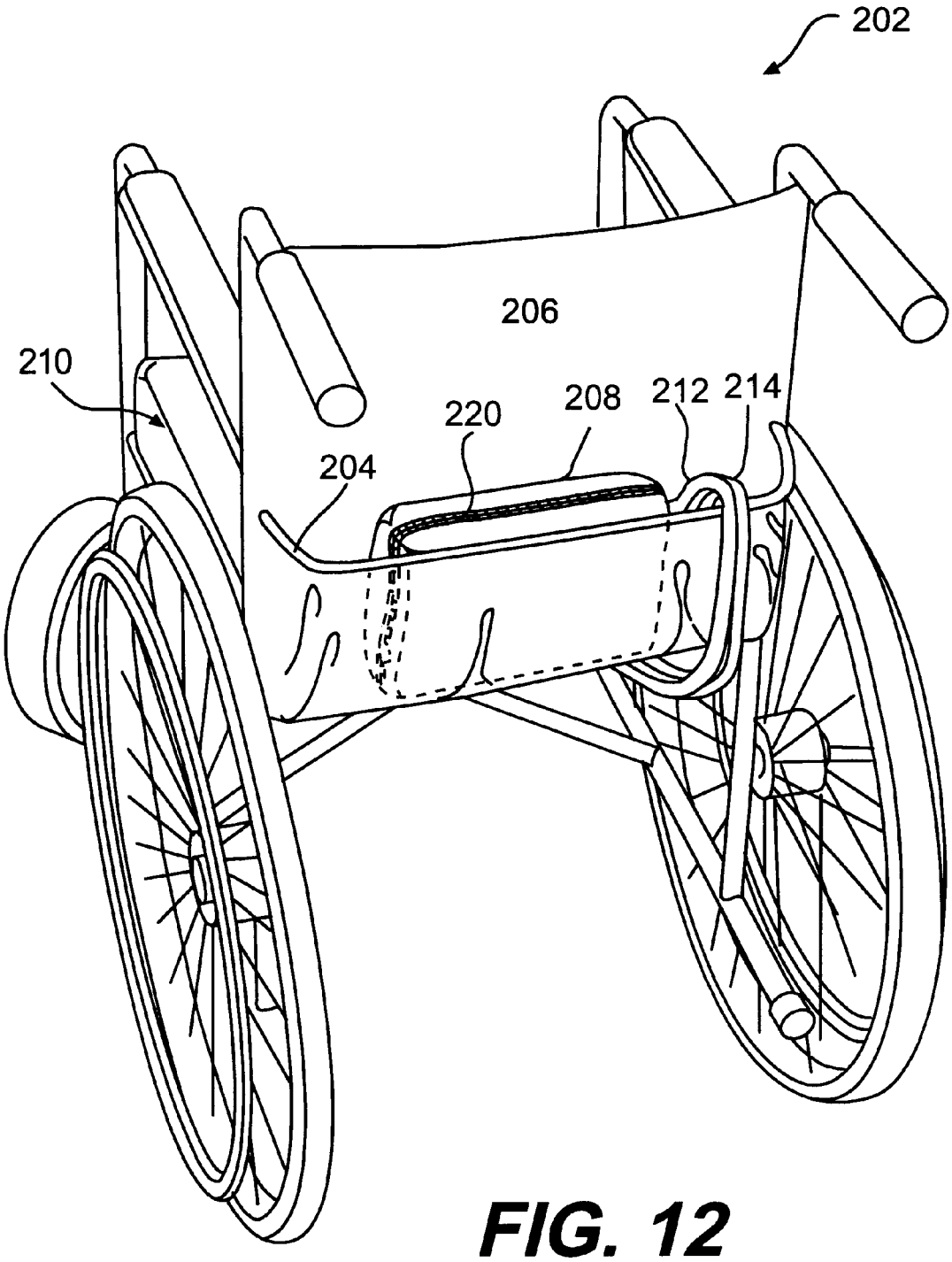
FIG. 12 is a generally rear perspective view of a fifth embodiment of the subject invention, primarily for use in connection with a wheelchair embodiment, and representing use of a "backpack" location for self-adjusting components thereof.
Figure 13:
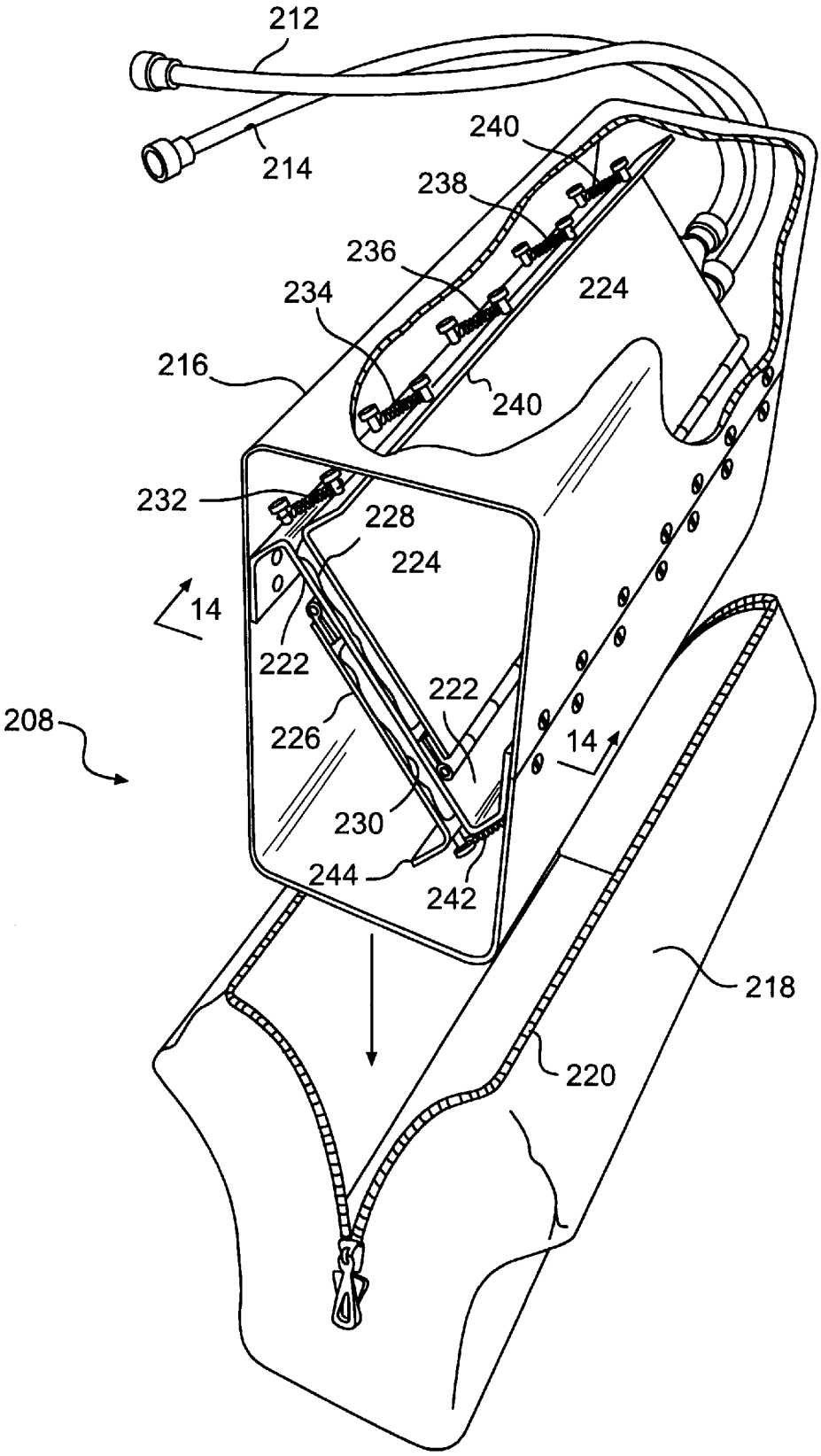
FIG. 13 is a generally disassembled view (in perspective and with partial cutaway) of the "backpack" features of the present exemplary embodiment of FIG. 12.
Figure 14:
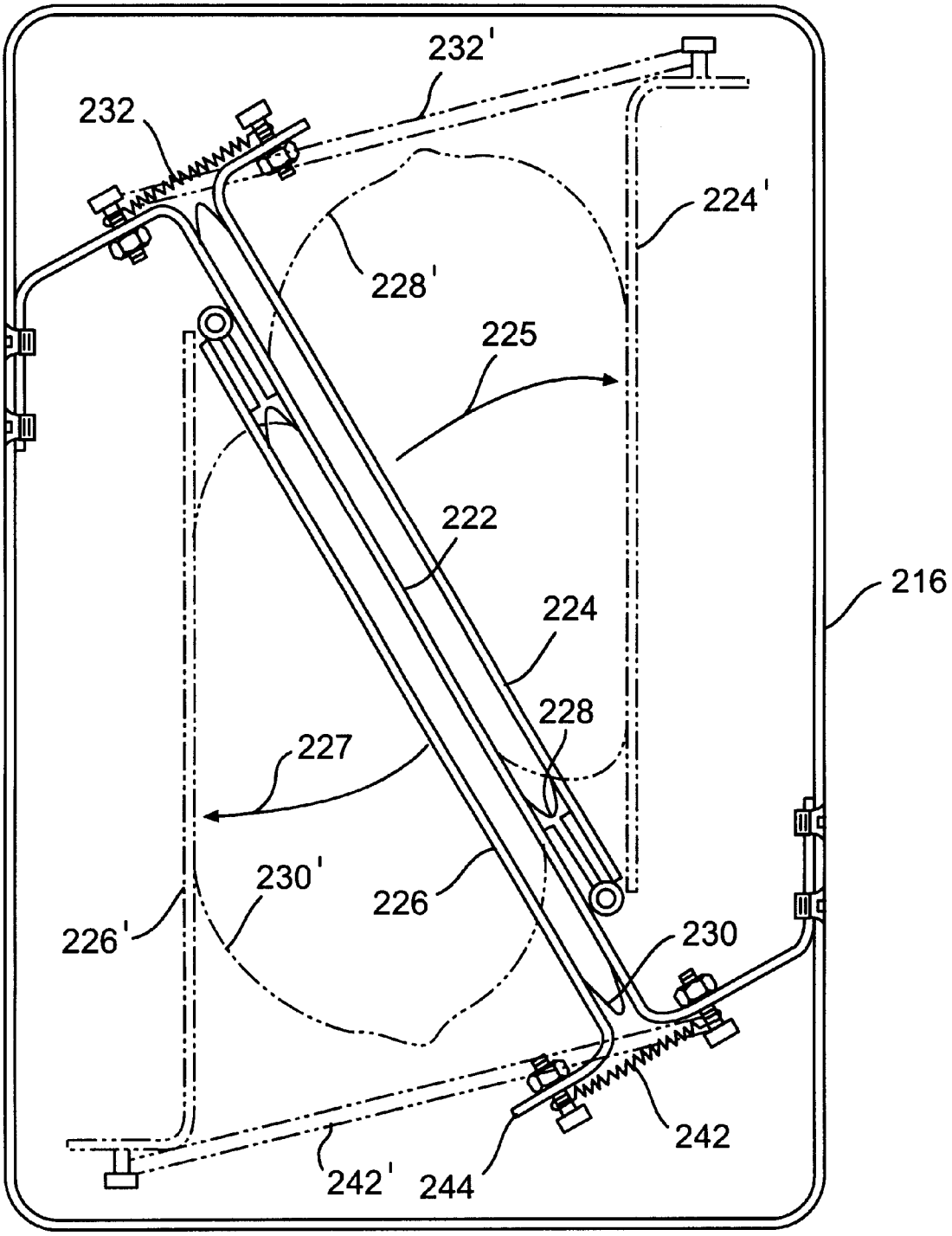
FIG. 14 is a generally end view of self-adjusting component features in accordance with the embodiment of present FIGS. 12 and 13 of the subject invention, taken along the view line 14—14 as indicated in FIG. 13.

Present FIGS. 12 through 14 represent yet a further exemplary embodiment in accordance with the subject invention, wherein reservoir means or similar are contained in a backpack means or similar construction stored to the rear of a wheelchair seat back, or other "remote" location arrangement.

For example, typical conventional wheelchair generally 202 is represented in the generally rear perspective view of present FIG. 12 as having a rear pouch or similar element generally 204 situated on the back side of seat back support generally 206. Pouches 204 are fairly commonplace, whether integrally constructed or retrofit to the wheelchair. Backpack means generally 208 in accordance with the subject invention are carried on such back support generally 204 of the wheelchair 202. At least one constant force fluid reservoir means is included therein, in fluid communication with one or more support chambers (not shown) in connection with support base generally 210. Such support base 210 may assume the form and features of support base 10, discussed above, or variations thereof in accordance with this invention. If a pair of such constant force fluid reservoir means are provided in fluid communication with two or more such resilient support chambers, a corresponding pair of fluid interconnection tubing 212 and 214 may be provided exiting from backpack means 208 and passing through a generally rear portion of support base 210 for interconnection with resilient support chambers received therein.

FIG. 13 represents a generally enlarged, disassembled view (and with partial cutaway illustration) of backpack means generally 208 in accordance with the subject invention. FIG. 14 represents a generally end view thereof, taken along the view line 14—14 as appears in present FIG. 13.

As represented primarily in FIGS. 13 and 14, such backpack means 208 may include a generally rectangular chamber generally 216, such as formed of aluminum or other metal or hardened substance, with a cover generally 218 received thereabout. A zippered arrangement 220 comprises one exemplary embodiment, though variations may be practiced.

A relatively fixed diagonal plate generally 222 is secured within rectangular chamber 216. Diagonal plate 222 commonly supports a pair of pivoting actuation plates 224 and 226, pivoting thereon on opposite sides of plate 222 (see arrows 225 and 227). With such an arrangement (opposing "wedges" within a rectangular chamber), the total pivoting space required by the two reservoir means arrangements is minimized. Dotted-line illustrations in FIG. 14 (plates 224' and 226', reservoirs 228' and 230', and springs 232' and 242') show close to maximum inflation of the reservoirs and pivoting of the plates.

Similar to other constant force fluid reservoir means in accordance with the subject invention, each such reservoir means includes a reservoir (228 and 230 respectively), a pivoting actuation plate (224 and 226 respectively), and constant force spring means respectively associated with each such actuation plate for automatic adjustment of the reservoir associated therewith. See springs 232, 234, 236, 238, and 240 interconnecting one end of diagonal plate 222 with the free pivoting end 242 of pivoting plate 224, and see representative spring 242 (others not shown) interconnecting diagonal plate 222 with free end generally 244 of plate 226. In some embodiments, the spring ends fixed to diagonal plate 222 may instead be fixed to other locations, such as an inside side wall of chamber 216. It will be readily appreciated by those of ordinary skill in the art that such constant force spring means may again be provided with an adjustable spring force, utilizing all of the above-discussed techniques for interjecting such adjustments.

Still further, it will be understood that different dimensions may be practiced in accordance with the subject invention. For example, in FIG. 14, rectangular chamber 216 may have a height of about 8.5 inches, a width of about 5.6 inches, and a length of about 14 inches in order to accommodate adequate reservoirs interconnected with the respective tubes 212 and 214 for operation with two or more independently adjustable resilient support chambers (not shown).

Likewise, it will be well appreciated that different materials, foam densities and ILDs, spring constants, and other characteristics may be varied generally in accordance with the subject invention, without departing from the spirit and scope thereof. Also, still further embodiments may be practiced, outfitted into all manner of transportation vehicles, including commercial, military, and space applications. Such could include use in space, as well, to accommodate acceleration or deceleration, since the invention is not gravity dependent. In any arrangement, protection and pressure reduction achieved may be applied to humans, or to other cargo, whether animal or inanimate objects.

It should be further understood by those of ordinary skill in the art that the forgoing presently preferred embodiments are exemplary only and that the attendant description thereof is likewise by way of words of example rather than words of limitation and their use does not preclude inclusion of such modifications, variations, and/or additions to the present invention, as would be readily apparent to one of ordinary skill in the art, the scope of the present invention being set forth in the appended claims.

What is claimed is:

1. A self-adjusting pressure relief seating system, comprising:

a main support body for receiving a person generally seated thereon, and having at least one adjustable resilient support bladder with fluid and resilient foam therein; and constant force fluid reservoir means, in fluid communication with said resilient support bladder, for automatically adjusting said bladder using potential energy, so as to maintain a generally constant predetermined internal pressure in said bladder responsive to changing loading on said main support body without requiring electronic controls.

2. A system as in claim 1, including at least two adjustable resilient support bladders with fluid and resilient foam therein, and which bladders are respectively independently adjustable, and with at least one of said bladders being in fluid communication with said constant force fluid reservoir means for automatic adjustment thereof.

3. A system as in claim 1, wherein said main support body is integrated into one of a geriatric chair and a seat in a transportation vehicle, with said constant force fluid reservoir means integrated into portions of such chair and seat.

4. A system as in claim 1, wherein said main support body includes a support base in a generally horizontal position, with said support bladder received on an upper surface thereof and said constant force fluid reservoir means received on a lower surface thereof.

5. A system as in claim 4, wherein said support base further includes adjustable attachment means for attaching said base to support rails of a conventional wheelchair, and further includes notches defined therein for accommodating cross bracing of such wheelchair.

6. A system as in claim 4, wherein said constant force fluid reservoir means includes a pivoting actuation plate having a mounted end thereof pivotally mounted on the lower surface of said support base and having a free pivoting end thereof, at least one constant force spring secured between said support base and said free pivoting end of said actuation plate, and a fluid reservoir captured between said base and said pivoting actuation plate so as to be influenced by potential energy of said constant force spring.

7. A system as in claim 6, further including spring adjustment means for adjusting tension and a number of springs secured between said base and said pivoting actuation plate, so as to correspondingly adjust the force applied to said reservoir.

8. A system as in claim 7, wherein the capacity of said reservoir, the density of said resilient foam within said support bladder, and the spring force of said constant force spring are predetermined so as to maintain a generally constant predetermined internal pressure for said support bladder responsive to changing loading thereon.

9. A system as in claim 8, wherein said reservoir has a capacity in a range of from about 0.5 liters to about 2.0 liters, said resilient foam of said support bladder has a density of from about 1.0 pounds per cubic foot to about 5.0 pounds per cubic foot, and said spring force is from about 1.5 pounds per inch to about 6.0 pounds per inch.

10. A system as in claim 1, including at least three adjustable resilient support bladders with fluid and resilient foam therein, and which bladders are respectively independently adjustable, and with at least one of said bladders being in fluid communication with said constant force fluid reservoir means for automatic adjustment thereof.

11. A system as in claim 10, wherein said bladders are arranged generally to cover respective left, right, and rear central portions of said main support body for receiving a patient generally seated thereon.

12. A system as in claim 11, further including a second constant force fluid reservoir means, with such pair of constant force fluid reservoir means respectively being in fluid communication with at least a respective pair of said support bladders for automatically adjusting same independent of one another.

13. A system as in claim 11, further including a foam pad received over said bladders and a removable cover received generally about said bladders and said foam pad.

14. A self-adjusting pressure relief patient seating support system for use with a wheelchair, comprising:

a main support body for receiving a patient generally seated thereon and having at least two adjustable fluid support bladders with fluid therein; and a pair of constant force fluid reservoir means mounted below said main support body, in respective fluid communication with said fluid support bladders, for automatically adjusting said bladders using potential energy so as to maintain a generally constant predetermined internal pressure respectively in each of said bladders responsive to changing patient loading on said main support body; and wherein said pair of constant force fluid reservoir means each include a reservoir and pivoting actuation plate functionally operative therewith, with such plate being adapted for pivoting from adjacent a lateral side of a wheelchair so that the pivoting free ends of such plates may be situated towards the middle of a wheelchair beneath said main support body so as to not interfere with structural supports of a wheelchair with which said patient seating support system is used.

15. A system as in claim 14, wherein said constant force fluid reservoir means each further include associated therewith constant force spring means secured respectively between the free ends of said plates and said main support body so as to provide a force tending to pivot each of said actuation plates towards and against its associated reservoir.

16. A system as in claim 15, wherein the force of said constant force spring means is adjustable.

17. A system as in claim 14, including at least three of said adjustable fluid support bladders with fluid therein.

18. A system as in claim 17, wherein at least one of said bladders further includes resilient foam therein and is otherwise open to ambient air pressure.

19. A system as in claim 17, wherein said support bladders each further include resilient foam therein.

20. A system as in claim 14, including at least three of said adjustable fluid support bladders with fluid therein and three corresponding constant force fluid reservoir means in respective fluid communication therewith.

21. A system as in claim 20, wherein said three bladders are arranged so as to respectively cover left, right, and rear central portions of said main support body for receiving a patient generally seated thereon, and wherein said three constant force fluid reservoir means are arranged beneath said main support body so as to avoid interference with structural supports of the wheelchair with which said system is used.

22. A system as in claim 21, wherein:

said three support bladders each further include resilient foam therein; and said system further includes a foam pad received over said bladders and a removable cover received generally about said bladders and said foam pad.

23. A sectionalized seating support arrangement with multiple independently acting support sections, comprising:

a main support body having a predetermined arrangement of independently adjustable resilient chambers with fluid and resilient foam in each of such chambers, and with the shape and size of each chamber defining a corresponding independently acting support section; and a plurality of constant force fluid reservoir means, each being respectively in fluid communication with a respective one of said chambers, for automatically adjusting such respective one chamber using potential energy so as to independently maintain a generally constant predetermined internal pressure in such respective one chamber responsive to changing loading on said main support body; and wherein said main support body comprises a seating arrangement including one of such as for a wheelchair, a geriatric care chair, a specialized patient care chair, an ergonomic chair, and a seat in a transportation vehicle.

24. A seating support arrangement as in claim 23, wherein said main support body includes at least three of said independently adjustable resilient chambers.

25. A seating support arrangement as in claim 23, wherein said constant force fluid reservoir means includes adjustable spring force means for providing said potential energy.

26. A seating support arrangement as in claim 23, wherein said constant force fluid reservoir means are located in predetermined positions relative to the seating arrangement associated therewith, including one of below, behind, and integrated into the seating arrangement.

27. A self-adjusting pressure relief seating system methodology, comprising the steps of:

providing a main support body for receiving a person generally seated thereon, and having at least one adjustable resilient support bladder with fluid and resilient foam therein; and providing a fluid reservoir in fluid communication with said resilient support bladder and with constant force applied thereto using potential energy, for automatically adjusting said bladder so as to maintain a generally constant predetermined internal pressure in said bladder responsive to changing loading on said main support body without requiring electronic contrals.

28. A methodology as in claim 30, further including providing one of said plurality of adjustable support bladders with fluid and resilient foam therein open to ambient atmospheric pressure so as to rely solely on the resilient support of said foam in such support bladder.

29. A methodology as in claim 27, further including the step of initially opening said adjustable resilient support bladder to ambient air pressure while unloaded, so that the resilient foam thereof fully opens said support bladder, and thereafter providing said fluid reservoir in an initial deflated condition in fluid communication with said resilient support bladder, whereby said fluid reservoir is initialized for maximum adjustment capacity thereof regardless of local ambient air pressure.

30. A methodology as in claim 27, wherein said main body includes a plurality of adjustable support bladders with fluid and resilient foam therein, and comprises a seating arrangement with said bladders arranged in a predetermined support arrangement.

31. A methodology as in claim 30, further including the step of providing at least one fluid reservoir, and selectively operatively associating each provided reservoir with a selected number of said support bladders.

32. A methodology as in claim 31, wherein said selected number is from one to four, inclusive.

33. A methodology as in claim 31, further including the step of selecting the amount of fluid originally introduced into a fluid reservoir and its corresponding operatively associated selected number of support bladders, and selecting the fluid capacity of each reservoir, together with a predetermined selected value for said constant force, such that the resulting bladder adjustability will accommodate loading changes on said main body of up to generally 300 pounds while maintaining the internal bladder pressure relative to local absolute pressure to a generally constant pressure within a preselected range.

34. A methodology as in claim 33, wherein three support bladders are provided with a corresponding respectively associated number of three reservoirs, each reservoir having a maximum adjustment capacity within a range of from about 0.5 liters to about 2.0 liters.

35. A methodology as in claim 34, wherein said resilient foam of said plurality of adjustable support bladders is provided with predetermined support characteristics, which may vary from one bladder to another, and which includes a foam density in a range of from about 1.0 pounds per cubic foot to about 5.0 pounds per cubic foot, and wherein said constant force applied to said fluid reservoirs is predetermined utilizing respective spring forces for each reservoir, in a range of from about 1.5 pounds per inch to about 6.0 pounds per inch.

36. A patient seating support system for use with a wheelchair having lateral support rails for attachment of said system thereto and with wheelchair support braces therebeneath, said system comprising:

a support base with attachment means for securing said base in a generally horizontal position on a wheelchair;

at least three independently adjustable resilient support chambers received on an upper surface of said support base, each such chamber comprising an air-tight sealable envelope with fluid and resilient foam therein, with each such chamber having a fluid interconnection port for accessing the interior thereof, and said three chambers being disposed on such support base upper surface in generally left, right, and rear central positions thereon;

at least a pair of constant force fluid reservoir means, received on a lower surface of said support base, and in fluid communication with said ports of at least two of said support chambers, for automatically adjusting said at least two chambers so as to maintain a generally constant predetermined internal pressure in said at least two chambers responsive to changing patient loading; and wherein said pair of constant force fluid reservoir means each include a reservoir and associated pivoting actuation plate with a mounted end thereof pivotally mounted beneath said support base and further having a free pivoting end thereof, so as to pivot towards the central portion of said base to avoid interference with the support braces of the wheelchair.

37. A system as in claim 36, further including a third constant force fluid reservoir means, so that such three reservoir means are respectively associated in fluid communication with said at least three independently adjustable resilient support chambers.

38. A system as in claim 36, further including a foam pad received on said support chambers and a removable cover received about said foam pad and said support chambers.

39. A system as in claim 36, wherein:

said support chambers disposed respectively in said left and right positions are respectively in fluid communication with said pair of constant force fluid reservoir means for automatic adjustment thereby; and said fluid interconnection port of said support chamber disposed in said rear central position is open to ambient air pressure.

40. A system as in claim 36, wherein each of said constant force fluid reservoir means includes adjustable constant force spring means associated between said free pivoting end of said pivoting actuation plate thereof and said support base, with constant force associated with each reservoir falling within a range of from about 1.5 pounds per inch spring force to about 6.0 pounds per inch spring force.

41. A system as in claim 40, wherein said support chambers comprise respective generally rectangular plastic bags, each having a capacity of from about 0.5 liters to about 2.0 liters.

42. A system as in claim 41, further including quick disconnect plastic tubing for providing fluid communication between said support chambers and said reservoirs.

* * * * *